US007605762B2

(12) United States Patent
Hsu et al.

(10) Patent No.: US 7,605,762 B2
(45) Date of Patent: Oct. 20, 2009

(54) ANTENNA

(75) Inventors: Chen-Hsuan Hsu, Hsin-Tien (TW); Po-Sheng Chen, Hsin-Tien (TW); Fu-Ren Hsiao, Hsin-Tien (TW); Tsung-Wen Chiu, Hsin-Tien (TW)

(73) Assignee: Advanced Connectek Inc. (TW)

( * ) Notice: Subject to any disclaimer, the term of this patent is extended or adjusted under 35 U.S.C. 154(b) by 0 days.

(21) Appl. No.: 11/999,115

(22) Filed: Dec. 4, 2007

(65) Prior Publication Data

US 2008/0136726 A1 Jun. 12, 2008

(30) Foreign Application Priority Data

Dec. 8, 2006 (TW) ..... 95221693 U

(51) Int. Cl.
*H01Q 1/38* (2006.01)
*H01Q 5/00* (2006.01)
*H01Q 9/04* (2006.01)

(52) U.S. Cl. ..... 343/700 MS; 343/846; 343/702

(58) Field of Classification Search ..... 343/700 MS, 343/702, 729, 792, 795, 846, 850
See application file for complete search history.

(56) References Cited

U.S. PATENT DOCUMENTS

| | | | | |
|---|---|---|---|---|
| 5,510,802 | A * | 4/1996 | Tsuru et al. | 343/700 MS |
| 5,734,350 | A * | 3/1998 | Deming et al. | 343/700 MS |
| 6,573,869 | B2 * | 6/2003 | Moore | 343/702 |
| 6,806,831 | B2 * | 10/2004 | Johansson et al. | 343/700 MS |
| 7,075,484 | B2 * | 7/2006 | Sung | 343/700 MS |
| 7,075,486 | B2 * | 7/2006 | Suzuki | 343/700 MS |
| 2003/0189522 | A1 * | 10/2003 | Zeilinger | 343/702 |
| 2006/0033665 | A1 * | 2/2006 | Yang | 343/700 MS |

* cited by examiner

*Primary Examiner*—Rexford N Barnie
*Assistant Examiner*—Crystal L Hammond
(74) *Attorney, Agent, or Firm*—Jackson Walker, LLP

(57) ABSTRACT

An antenna has a ground plane, a radiating member, a signal-feeding member and two grounding supports. The radiating member is suspended over and separated from the ground plane and has two opposite non-radiating edges. Each non-radiating edge has a middle section. Each grounding support is connected perpendicularly to the middle section of one non-radiating edge of the radiating member and the ground plane. The grounding supports connected between the radiating member and the ground plane excellently improve the combination of the radiating member and the ground plane to prevent the antenna from inadvertently disassembling.

3 Claims, 3 Drawing Sheets

ANTENNA

BACKGROUND OF THE INVENTION

1. Field of the Invention

The present invention relates to an antenna, and more particularly to an antenna that has a ground plane, a radiating member and two grounding supports connected to the ground plane and the radiating member and securely holing the radiating member.

2. Description of Related Art

A conventional antenna has a ground plane, a radiating member and a feeding pin. The radiating member is separated from and suspended over the ground plane. The feeding pin is mounted perpendicularly on the ground plane and serves as a supporting post to securely hold the radiating member over the ground plane. However, the feeding pin between the ground plane and the radiating member easily loosens to inadvertently disassemble the antenna. Furthermore, the antenna cannot prevent lightning strokes.

With reference to FIG. 1, another antenna, a patch antenna, has a dielectric substrate (3), a radiating patch (30*a*), a ground plane and a micro-strip (4). The dielectric substrate (3) has an outer edge and two opposite surfaces. The radiating patch (30*a*) is mounted on one surface of the dielectric substrate (3). The ground plane is mounted on the other surface of the dielectric substrate (3) opposite to the radiating patch (30*a*). The micro-strip (4) is bent, is mounted on the surfaces and crosses the outer edge of the dielectric substrate (3) and has two ends. One end of the micro-strip (4) is connected to the radiating patch (30*a*) and the other end is located near the ground plane. However, the patch antenna has lower gains when compared to the conventional antenna and also cannot prevent lightning strokes.

To overcome the shortcomings, the present invention provides an antenna to mitigate or obviate the aforementioned problems.

SUMMARY OF THE INVENTION

The main objective of the invention is to provide an antenna that has a ground plane, a radiating member and two grounding supports connected to the ground plane and the radiating member and securely holing the radiating member.

An antenna in accordance with present invention comprises a ground plane, a radiating member, a signal-feeding member and two grounding supports. The radiating member is suspended over and separated from the ground plane and has two opposite non-radiating edges. Each non-radiating edge has a middle section. Each grounding support is connected perpendicularly to the middle section of one non-radiating edge of the radiating member and the ground plane. The grounding supports connected between the radiating member and the ground plane excellently improve the combination of the radiating member and the ground plane to prevent the antenna from inadvertently disassembling.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
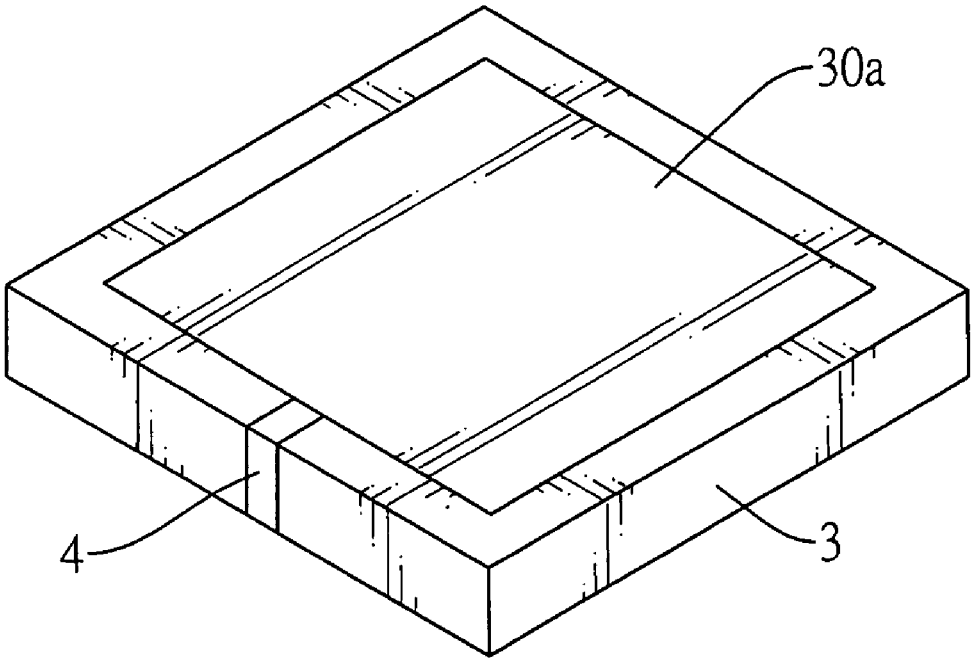
FIG.1 PRIOR ART
FIG. 1 is a perspective view of a conventional patch antenna in accordance with the prior art.
Figure 2:
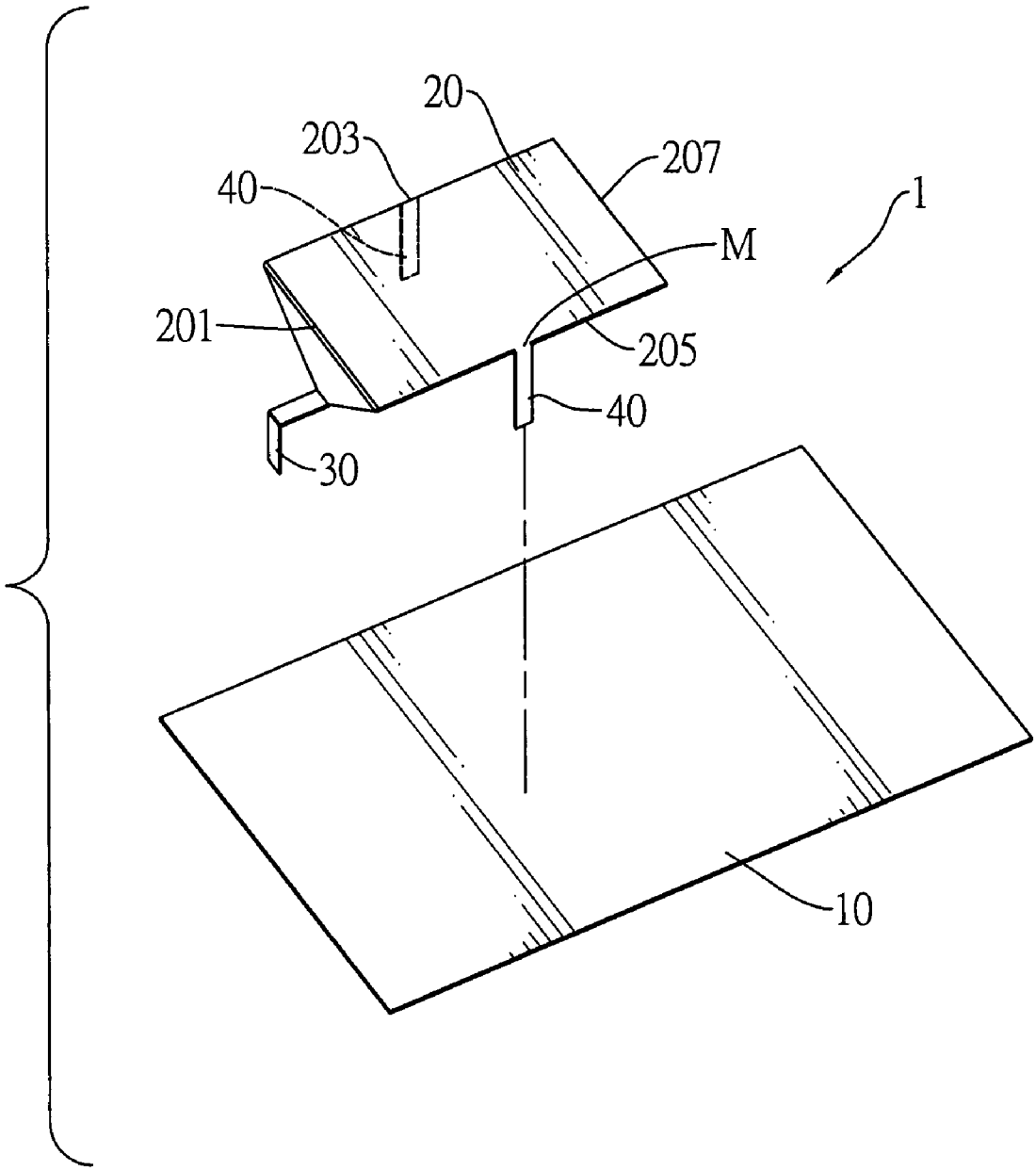
FIG. 2 is an exploded perspective view of an antenna in accordance with the present invention.
Figure 3:
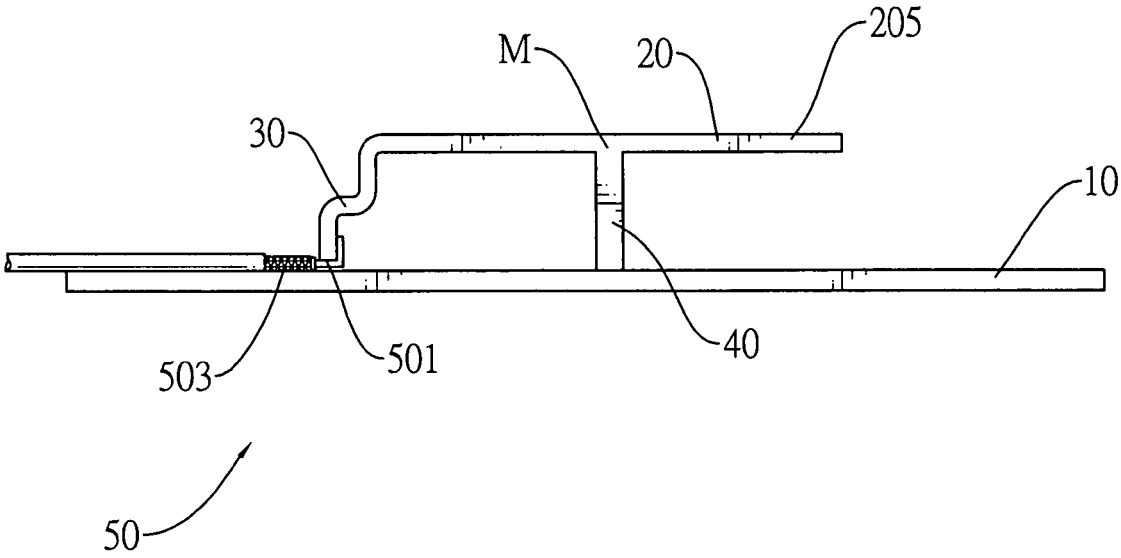
FIG. 3 is a side view of the antenna shown in FIG. 2.

With reference to FIGS. 2 and 3, an antenna (1) in accordance with the present invention is connected to a feed cable (50). The feed cable (50) is connected to an electronic device and has a positive signal wire (501), an inner insulative layer, a negative signal wire (503) and an outer insulative layer. The inner insulative layer is tubular and is mounted around the positive signal wire (501). The negative signal wire (503) is a mesh and is mounted around the inner insulative layer. The outer insulative layer is mounted around the negative signal wire (503).

The antenna (1) comprises a ground plane (10), a radiating member (20), a signal-feeding member (30) and two grounding supports (40).

The ground plane (10) is made of metal.

The radiating member (20) is rectangular and made of metal, is suspended over and separated from the ground plane (10) and has two opposite non-radiating edges (203, 205), a signal-feeding edge (201) and a radiating edge (207). The non-radiating edges (203, 205) are parallel to each other and each non-radiating edge (203, 205) has a middle section (M). The signal-feeding edge (201) is formed between the non-radiating edges (203, 205). The radiating edge (207) formed between the non-radiating edges (203, 205) and is opposite to the signal-feeding edge (201).

The signal-feeding member (30) is formed on and protrudes from the signal-feeding edge (201) of the radiating member (20) toward the ground plane (10) and is connected to the positive signal wire (501) of the feed cable (50).

Each grounding support (40) is connected perpendicularly to the middle section (M) of one non-radiating edge (203, 205) of the radiating member (20) and the ground plane (10). The grounding support (40) may be formed integrally on and protrude perpendicularly from the middle section (M) and is mounted perpendicularly on the ground plane (10) by soldering. Furthermore, the grounding support (40) may be formed integrally on and protrude perpendicularly from the ground plane (10) and is mounted perpendicularly on one middle section (M) of the radiating member (20).

The radiating member (20), the signal-feeding member (30) and the grounding supports (40) may be formed by stamping a single piece of metal sheet. Alternatively, the ground plane (10) and the grounding supports (40) are formed by stamping a single metal sheet.

When the antenna (1) is placed outdoors and the radiating member (20) suffers lightning strokes, the grounding supports (40) transmit the current of the lightning to the ground plane (10) and then the current is directed by the ground plane (10) out of the electronic device and the antenna (1). Therefore, the antenna (1) prevents the electronic device from being damaged by the lightning strokes. Furthermore, the two grounding supports (40) connected between the radiating member (20) and the ground plane (10) excellently improve the combination of the radiating member (20) and the ground plane (10) to prevent the antenna (1) from inadvertently disassembling. Therefore, the radiating member (20) is securely held by the grounding supports (40) on the ground plane (10).

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An antenna comprising:

a ground plane;

a radiating member being rectangular, suspended over and separated from the ground plane and having two opposite non-radiating edges being parallel to each other and each non-radiating edge having a middle section;

a signal-feeding edge formed between the non-radiating edges; and a radiating edge formed between the non-radiating edges and being opposite to the signal-feeding edge;

a signal-feeding member formed on and protruding from the signal-feeding edge of the radiating member toward the ground plane; and two grounding supports, each grounding support connected perpendicularly to the middle section of one non-radiating edge of the radiating member and the ground plane.

2. The antenna as claimed in claim 1, wherein the grounding supports are formed integrally on and perpendicularly protrude respectively from the middle section of the radiating member and mounted perpendicularly on the ground plane.

3. The antenna as claimed in claim 2, the ground plane and the radiating member are made of metal.

* * * * *